United States Patent [19]

Woodward

[11] Patent Number: 4,721,164

[45] Date of Patent: Jan. 26, 1988

[54] METHOD OF HEAT EXCHANGE FOR VARIABLE-CONTENT NITROGEN REJECTION UNITS

[75] Inventor: Donald W. Woodward, New Tripoli, Pa.

[73] Assignee: Air Products and Chemicals, Inc., Allentown, Pa.

[21] Appl. No.: 904,121

[22] Filed: Sep. 4, 1986

[51] Int. Cl.[4] ..... F25J 3/02; E21B 43/24; E21B 43/00

[52] U.S. Cl. ..... 166/372; 166/267; 165/1; 165/166; 165/101; 62/11; 62/36; 62/31

[58] Field of Search ..... 62/11, 36, 37, 31; 166/265, 266, 267, 372; 165/47, 166, 1, 101

[56] References Cited

U.S. PATENT DOCUMENTS

| | | | |
|---|---|---|---|
| 3,282,334 | 11/1966 | Stahlheber | 62/36 |
| 3,989,478 | 11/1976 | Jones | 166/267 |
| 4,050,506 | 9/1977 | Small | 62/37 |
| 4,451,275 | 5/1984 | Vines et al. | 62/31 X |
| 4,455,158 | 6/1984 | Vines et al. | 62/31 X |
| 4,496,382 | 1/1985 | Geist et al. | 62/31 |
| 4,504,295 | 3/1985 | Davis et al. | 62/31 |
| 4,592,767 | 6/1986 | Pahade et al. | 62/31 |
| 4,622,053 | 11/1986 | Tomilson et al. | 62/31 X |

*Primary Examiner*—William R. Cline
*Assistant Examiner*—John K. Ford
*Attorney, Agent, or Firm*—Willard Jones, II; James C. Simmons; William F. Marsh

[57] ABSTRACT

The present invention relates to an improvement to a nitrogen or carbon dioxide rejection process used in an enhanced oil recovery project. In rejection processes for enhanced oil recovery projects at least a portion of a feed stream from the reservoir is precooled in a heat exchanger before distillation to separate the feed stream into a nitrogen or carbon dioxide fraction and a methane fraction. The improvement to this rejection process is the precooling of the feed stream by heat exchange with the nitrogen or carbon dioxide fraction and the methane fractions in a plate-fin heat exchanger with at least three circuits. In the heat exchanger, a first circuit is utilized as a nitrogen or carbon dioxide circuit to conduct all of the nitrogen or carbon dioxide coolant during the first part of the project life, and a minor portion of the total nitrogen or carbon dioxide coolant during the second and last part of the project life; a second circuit is utilized as a methane circuit to conduct a minor portion of the methane coolant during the first part of the project life, and all of the methane coolant during the second and last part of the project life, a third circuit is utilized as a common circuit to conduct the remaining major portion of the methane coolant during the first part of the project life, and the remaining major portion of the nitrogen or carbon dioxide coolant during the second and last part of the project life. Switching from methane coolant to nitrogen or carbon dioxide coolant in the third circuit is done when the nitrogen or carbon dioxide coolant flow exceeds the methane coolant flow.

2 Claims, 3 Drawing Figures

PRIOR ART

METHOD OF HEAT EXCHANGE FOR VARIABLE-CONTENT NITROGEN REJECTION UNITS

TECHNICAL FIELD

The present invention is directed to efficient heat exchange for a variable-content nitrogen rejection unit.

BACKGROUND OF THE INVENTION

The production of natural gas or methane from an underground reservoir requires purification of the feedstocks to remove undesired components, for example nitrogen or carbon dioxide. The production of crude oil and natural gas from an underground reservoir can be "enhanced" by the introduction of a gas, such as nitrogen, into the reservoir to increase the pressure. This elevated pressure increases the amount of crude oil that can be recovered from the reservoir. As more crude oil is removed from the reservoir, the concentration of nitrogen in the crude oil increases from the naturally occurring level.

The crude oil recovered from the underground reservoir is flashed to a lower pressure and separated into liquid crude oil and gaseous natural gas streams. The majority of the nitrogen remains in the natural gas stream, and must be separated or "rejected" from the natural gas in one or more "nitrogen rejection units" or NRU.

The NRU comprises precooling and distillation processes. The gaseous natural gas stream is cooled in a precooler, and then separated by distillation into at least two streams, one a substantially methane product stream and the other a substantially nitrogen waste stream. Both the methane and nitrogen streams are countercurrently heat exchanged with the feed in the precooler to cool the natural gas feed stream to the distillation column.

Previously, the feed to a Nitrogen Rejection Unit (NRU) was natural gas with the naturally occurring nitrogen content and thus the feed to the NRU contained a constant nitrogen feed composition. Recent methods of enhanced oil recovery utilizing nitrogen injection/rejection processes necessitated the design of a NRU that will process a feed of widely varying composition. Conventional heat exchanger designs for an NRU with variable nitrogen content in the feed currently have large inefficiencies in heat transfer caused by the requirement to oversize the heat exchange circuits to accommodate changes in coolant flow with time. Oversize circuits reduce the heat transfer coefficients between major duty streams. The nitrogen flowrate may increase by a factor of 160, coupled with a methane flowrate decreasing by a factor of 5. These oversized heat exchangers use a fixed plate-fin configuration with constant passage number and passage arrangement of each circuit throughout the life of the particular project.

These inefficiencies of heat transfer cause heat exchanger designs to be much larger and more costly than would be necessary for a design with a fixed feed composition. There exists a need to decrease heat exchanger size and cost by improving the heat transfer process.

Enhanced oil recovery with nitrogen injection/rejection has been commercialized on a large scale only recently. Attempts have not been made to solve the heat exchanger inefficiency problem, but rather only to overcome the problem by installing more heat transfer surface.

BRIEF SUMMARY OF THE INVENTION

An improved process and apparatus for increasing the efficiency of heat exchange in a nitrogen rejection unit (NRU) used for enhanced oil recovery is achieved by utilizing a "common circuit" which may be facilitated by a plate-fin heat exchanger with a common circuit which has a greater number of passages than either the methane or nitrogen circuits. This common circuit is dedicated only to methane for the first part of the particular enhanced oil recovery project using an NRU, and only to nitrogen for the second and last part of the project.

DETAILED DESCRIPTION

The plate-fin (i.e. core) heat exchanger which precools the feed to the distillation equipment of an NRU used in a particular enhanced oil recovery project utilizes three major streams: the feed gas (being cooled), and the nitrogen coolant and methane coolant (being warmed). The major duty streams are feed and methane in the early years of the project and feed and nitrogen in the later years. The present invention accomplishes more intimate contact, and therefore increases heat transfer coefficients, between the major duty streams throughout the life of the project.

Figure 1:
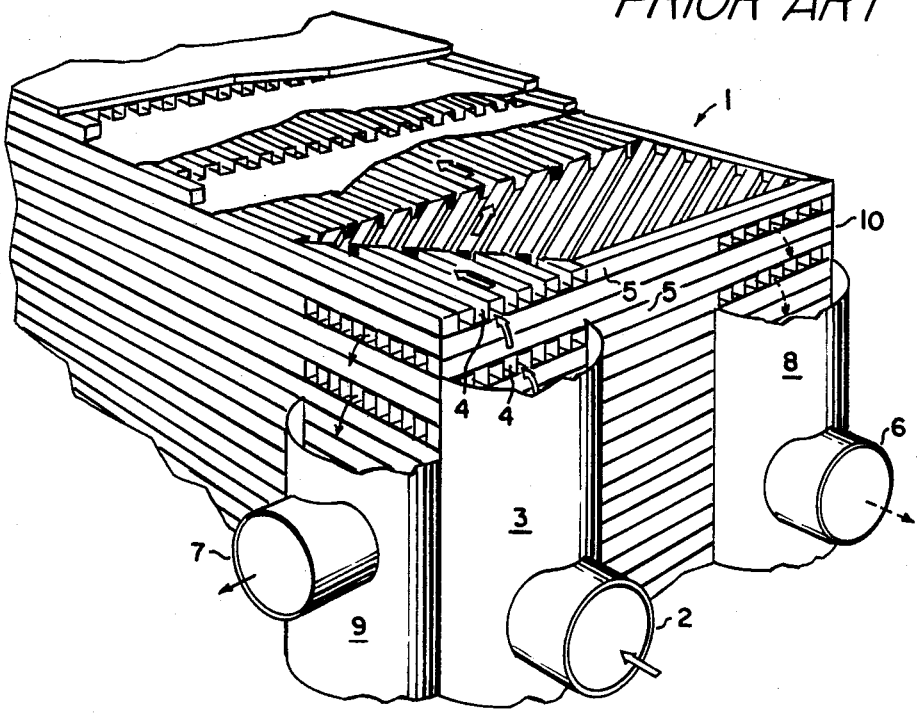
FIG. 1 is a partial fragmented perspective view of a conventional plate-fin heat exchanger with portions removed to show interior detail thereof.

A perspective view of a portion of a conventional plate-fin heat exchanger, usable to practice the process of the invention as will be more fully described, is shown as 1 in FIG. 1. This view with portions removed to show interior details thereof illustrates the relationship between a header, passages, and distributors. The feed enters the heat exchanger 1 via the nozzle 2 of inlet header 3. The feed is divided proportionately into the distributors 4 of the passages 5 associated with that header 3. Coolant streams, which are in heat exchange with the feed and which cool the feed, exit heat exchanger 1 via nozzles 6 and 7 of outlet headers 8 and 9, respectively. A parting sheet 10 separates each layer of passage.

Figure 2:
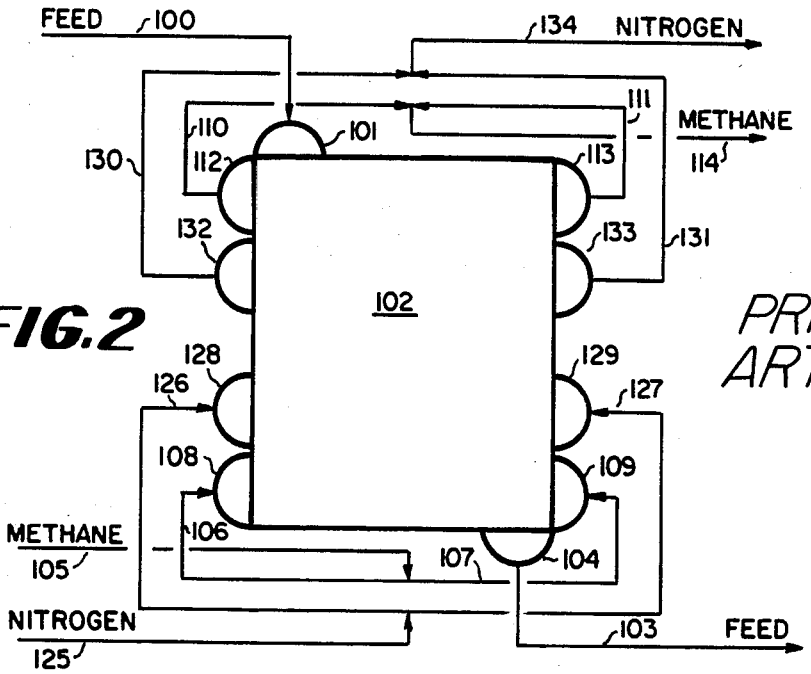
FIG. 2 PRIOR ART
FIG. 2 is a schematic representation of a conventional dual header heat exchanger.

FIG. 2 shows a conventional dual header heat exchanger 102 wherein each coolant stream enters into and exits from two separate headers. Feed 100 enters the feed inlet header 101, is cooled in heat exchanger 102, and the cooled feed 103 exits via feed outlet header 104. The inlet methane coolant stream 105 is split into two streams via conduits 106 and 107, which enter heat exchanger 102 via methane inlet headers 108 and 109, respectively, wherein the methane coolant is warmed via heat exchange with the feed. The warmed methane coolant, via conduits 110 and 111, exits heat exchanger 102 via methane outlet headers 112 and 113, respectively, and are combined to form the outlet methane coolant stream 114. Similarly, the inlet nitrogen coolant 125 is split into two streams via conduits 126 and 127, which enter heat exchanger 102 via nitrogen inlet headers 128 and 129, respectively, wherein the nitrogen coolant is warmed via heat exchange with the feed. The warmed nitrogen coolant, via conduits 130 and 131, exits heat exchanger 102 via nitrogen outlet headers 132 and 133, respectively, and are combined to form the outlet nitrogen coolant stream 134.

In accord with the present invention, three circuits containing coolant are heat exchanged with the feed, which feed is precooled before entry to the distillation equipment. A first circuit dedicated only to nitrogen receives all the nitrogen in the early years of the project *but only a portion of the total nitrogen in the later years* of the project. A second circuit dedicated only to methane receives a portion of the total methane initially and all the methane during the second and last part of the project. A third or common circuit, that may receive either nitrogen coolant or methane coolant, is utilized to be in intimate contact with the feed passages which are being cooled. The common circuit has a greater number of passages than either of the dedicated circuits.

Figure 3:
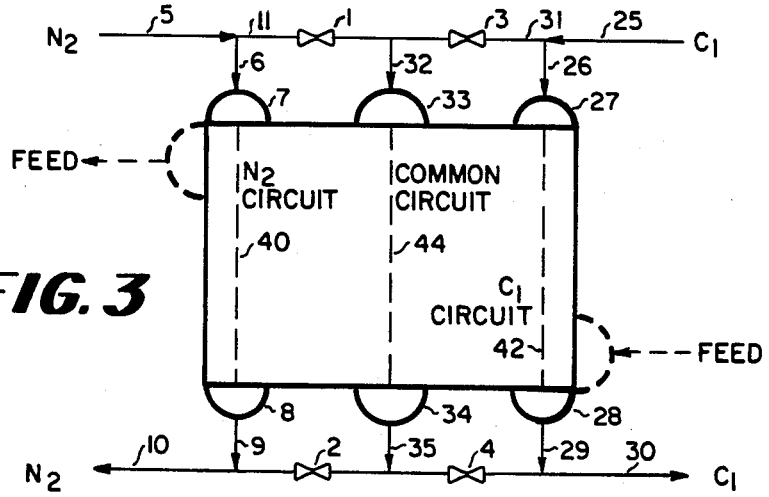
FIG. 3 is a schematic representation of the process according to the invention.

Referring to FIG. 3, when the enhanced oil recovery project for a given well or field is initiated, valves 1 and 2 are closed and valves 3 and 4 are open. All of the nitrogen in conduit 5, which was "rejected" from the natural gas product, flows via conduit 6 and nitrogen inlet header 7 into the nitrogen circuit 40, and exits the circuit 40 via nitrogen outlet header 8 and conduits 9 and 10. The methane in conduit 25 flows partially via conduit 26 and methane inlet header 27 into the methane circuit 42, and exits the circuit 42 via methane outlet header 28 and conduits 29 and 30. The remainder of methane 25 flows via conduits 31 and 32 and common inlet header 33 through the common circuit 44, exits the circuit 44 via common outlet header 34 and conduit 35, flows through valve 4, and exits the system via conduit 30. Of course, a major portion of the total methane coolant flows through the common circuit and a minor portion through the dedicated methane circuit since the common circuit has a greater number of passages then the dedicated circuit and the flow is distributed equally between passages. At a "switchover" point of the recovery project as the nitrogen content increases, valves 3 and 4 can be closed, while valves 1 and 2 are opened. The nitrogen in stream 5 now flows only partially via conduit 6 into the nitrogen circuit 40, and exits via conduits 9 and 10. The remainder of nitrogen in conduit 5 flows via conduit 11, through valve 1, via conduit 32 and common inlet header 33, through the common circuit 44, exits the circuit 44 via common outlet header 34 and conduit 35, flows through valve 2, and exits the system via conduit 10. Again, a major portion of the total nitrogen coolant flows through the common circuit and a minor portion through the dedicated nitrogen circuit since the common circuit has a greater number of passages than the dedicated circuit and the flow is distributed equally between passages.

All three circuits (nitrogen 40, common 44, and methane 42) consist of a number of passages which exchange heat with the feed passages. The coolant is, of course, distributed approximately equally between the passages being utilized for that coolant.

The "switchover" point of the project is chosen primarily to ensure that the greater of either the nitrogen or methane coolant flows is split between two coolant circuits, wherein one circuit is dedicated to that coolant and the other is the common circuit; the switchover will occur when the pressure drop in the nitrogen circuit becomes excessive. The switchover point can be determined for a particular enhanced oil recovery project by calculating the net compression and/or pumping power required for the NRU. When this calculation indicates that net compression and/or pumping power will decrease, the common circuit should be switched from methane coolant to nitrogen coolant.

Usually, the pressure of the NRU feed is insufficient to meet the pressure drop requirements of the NRU, and compressors and/or pumps are required in the NRU. Power may be required for compressing the feed stream to the NRU, the product methane stream, and *the product nitrogen stream (e.g. if reinjected into the* reservoir rather than vented to atmosphere), and for pumping these streams within the NRU. Whether particular compressors or pumps are required depend upon the operating conditions of the particular enhanced oil recovery project.

The net power requirement of the NRU gradually increases as the nitrogen coolant flow increases, causing a corresponding increase in pressure drop in the nitrogen circuit. Switching the common circuit from methane coolant to nitrogen coolant will, of course, decrease the pressure drop of the nitrogen circuit and increase the pressure drop of the methane circuit. The switchover point is reached when the net NRU power requirement will begin to decrease after the switch.

As shown in FIG. 3, the changeover of the common circuit from methane to nitrogen can be accomplished with four shutoff valves. However, it is within the scope of the invention to utilize equivalent apparatus such as replacement of the four valves with two two-way valves. Additionally, it is possible to use individual flanges and blinds instead of valves since the change in flows occurs only once in the lifetime of the project.

The process of the present invention is not specific to $N_2/CH_4$ systems and could be applied to other enhanced oil recovery systems such as $CO_2/CH_4$.

Operating conditions for a $N_2/CH_4$ system may have a feed pressure as low as 300 psig, which is the lower limit for auto refrigeration, and as high as 1,000 psig which is the upper limit for plate fin exchangers. The feed compositions for a particular plant may increase from 5% $N_2$ to 80% $N_2$ at which point $CH_4$ recovery becomes uneconomical. The nitrogen waste stream composition is usually 75% to 99% $N_2$ with the pressure at atmospheric if venting and as high as 300 psig if the nitrogen is reinjected back to the reservoir. The methane product stream composition can range between 20% and 3% $N_2$ as determined by the customers request with pressures ranging between 30 and 300 psig.

The conventional NRU precooler, as illustrated in Table 1, can be compared to the present invention, as illustrated in Table 2.

TABLE 1

| CONVENTIONAL PRECOOLER[a] | Feed | Nitrogen | Methane |
|---|---|---|---|
| Stream Name | A | B | C |
| No. of Passages | 45 | 45 | 45 |
| Film Coefficient | | | |
| Initial part of project | 300 | 15 | 200 |
| Final part of project | 300 | 100 | 60 |

[a]Core height = 42.4 inch

TABLE 2

| PRESENT INVENTION[b] | Feed | Nitrogen | Methane | Common |
|---|---|---|---|---|
| Stream Name | A | B | C | D |
| No. of Passages | 45 | 10 | 10 | 35 |

TABLE 2-continued

| | PRESENT INVENTION[b] | | | |
|---|---|---|---|---|
| | Feed | Nitrogen | Methane | Common |
| Film Coefficient | | | | |
| Initial part of project | 300 | 50 | 200 | 200 |
| Final part of project | 300 | 100 | 200 | 100 |

[b]Core height = 31.4 inch

Comparison of the exchangers of Tables 1 and 2 illustrate the difference between the conventional precooler and that of the present invention. Table 1 shows the conventional precooler. Each of the 45 feed passages ("A") is in heat exchange relationship with both a nitrogen passage ("B") and a methane passage ("C"), in a "BAC" arrangement, giving a total of 135 passages through the precooler.

In the present invention, only 10 of the 45 feed passages ("A") is exchanged in like manner for a subtotal of 30 passages, while each of the remaining 35 feed passages ("A") is in heat exchange relationship with one common passage ("D") for a subtotal of 70 passages. The present invention has a total of 100 passages through the precooler, compared to 135 passages for the conventional precooler.

The number of passages in the heat exchanger of the present invention is reduced, for example by 26%, due to the increase in efficiency of heat transfer in the precooler, which is increased due to the maximization of flow through each passage over the life of the project.

The core height of the conventional preheater shown in Table 1 is 42.4 inches compared to the 31.4 inch core height of the present invention shown in Table 2. Core height is calculated as follows:

$$H_c = \Sigma n \times (H_f + T)$$

where $H_c$=core height n=total number of passes through precooler $H_f$=fin height T=parting sheet thickness with all lengths in inches. For both examples in Tables 1 and 2, the parting sheet thickness is 0.064 inch and the fin height is 0.25 inch.

As one can see from these examples, the invention can save over 26% of surface area which could amount to $20,000 for a single large exchanger. If a standard 36 inch exchanger was the maximum core height, the prior art process would be forced to use two exchangers while only one would be required with the present invention; this is a savings considerably more than $20,000. This savings is achieved while maintaining intimate contact between warming and cooling streams since there is always a feed passage next to each nitrogen and methane passage.

The maximum pressure drop for each circuit is identical for each example. If one were to simply reduce the exchanger size of a conventional precooler, the maximum pressure drops observed for nitrogen and methane would be excessive and require additional compression.

Another saving in manufacturing costs arises from the fact that dual headers, which are frequently needed using a conventional precooler, may be single headers plus a common header when using the process of the present invention since the nitrogen and methane coolant streams enter two separate cooling circuits when at maximum flow. Dual headers are used in conventional exchangers because maximum flows of nitrogen and methane must each enter a single circuit, and because limitations of available header sizes cause excessive pressure drops.

Heat transfer coefficients are also higher with the invention because fewer passages are installed and higher velocities are achieved for whichever stream is not presently in the common circuit.

It is within the scope of the invention to utilize one or more heat exchangers or circuits to perform the functions of the precooling section described by the present invention.

While particular embodiments of the invention have been described, it will be understood, of course, that the invention is not limited thereto since many obvious modifications can be made, and it is intended to include within this invention any such modifications as will fall within the scope of the invention as defined by the appended claims.

Having thus described our invention, what is desired to be protected by Letters Patent of the United States is set forth in the appended claims.

I claim:

1. In a given project to recover crude oil and natural gas from an underground reservoir via an enhanced oil recovery process utilizing nitrogen injection and rejection units, wherein at least a portion of a feed stream from the reservoir is precooled before distillation to separate a nitrogen fraction and a methane fraction, the improvement comprising precooling the feed stream by heat exchange with the nitrogen and methane fractions in a plate-fin heat exchanger with at least three circuits:

(a) utilizing a first circuit as a nitrogen circuit to condut all of the nitrogen coolant during the first part of the project life, and a minor portion of the the total nitrogen coolant during the second and last part of the project life, (b) utilizing a second circuit as a methane circuit to conduct a minor portion of the methane coolant during the first part of the project life, and all of the methane coolant during the second and last part of the project life, (c) utilizing a third circuit as a common circuit to conduct the remaining major portion of the methane coolant during the first part of the project life, and the remaining major portion of the nitrogen coolant during the second and last part of the project life, and (d) switching from methane coolant to nitrogen coolant in the third circuit when nitrogen coolant flow exceeds methane coolant flow.

2. In a given project to recover crude oil and natural gas from an underground reservoir via an enhanced oil recovery process utilizing carbon dioxide injection and rejection units, wherein at least a portion of a feed stream from the reservoir is precooled before distillation to separate a methane fraction and a carbon dioxide fraction, the improvement comprising precooling the feed stream by heat exchange with the methane and carbon dioxide fractions in a plate-fin heat exchanger with at least three circuits:

(a) utilizing a first circuit as a carbon dioxide circuit to conduct all of the carbon dioxide coolant during the first part of the project life, and a minor portion of the the total carbon dioxide coolant during the second and last part of the project life, (b) utilizing a second circuit as a methane circuit to conduct a minor portion of the methane coolant during the first part of the project life, and all of the methane coolant during the second and last part of the project life, (c) utilizing a third circuit as a common circuit to conduct the remaining major portion of the methane coolant during the first part of the project life, and the remaining major portion of the carbon dioxide coolant during the second and last part of the project life, and (d) switching from methane coolant to carbon dioxide coolant in the third circuit when carbon dioxide coolant flow exceeds methane coolant flow.

* * * * *